US006564589B2

(12) United States Patent
Fehrenbacher

(10) Patent No.: US 6,564,589 B2
(45) Date of Patent: May 20, 2003

(54) LATCH NEEDLE HAVING A STEPPED SAW SLOT

(75) Inventor: Eckhard Fehrenbacher, Rottenburg (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/088,599

(22) PCT Filed: Jul. 10, 2001

(86) PCT No.: PCT/DE01/02567

§ 371 (c)(1),
(2), (4) Date: Mar. 21, 2002

(87) PCT Pub. No.: WO02/08505

PCT Pub. Date: Jan. 31, 2002

(65) Prior Publication Data

US 2002/0134115 A1 Sep. 26, 2002

(30) Foreign Application Priority Data

Jul. 22, 2000 (DE) ..... 100 35 826

(51) Int. Cl.[7] ..... D04B 35/04
(52) U.S. Cl. ..... 66/121
(58) Field of Search ..... 66/122, 121, 116, 66/123

(56) References Cited

U.S. PATENT DOCUMENTS

| | | | | | |
|---|---|---|---|---|---|
| 1,433,123 | A | * | 10/1922 | Corey | 66/122 |
| 3,677,035 | A | * | 7/1972 | Wiederhut et al. | 66/122 |
| 3,934,109 | A | * | 1/1976 | Shepard et al. | 66/122 |
| 4,020,319 | A | * | 4/1977 | Shepard et al. | 66/122 |
| 4,905,364 | A | * | 3/1990 | Berentzen | 66/122 |
| 5,509,280 | A | * | 4/1996 | Schuler et al | 66/121 |

FOREIGN PATENT DOCUMENTS

| | | |
|---|---|---|
| DE | 586 678 | 10/1933 |
| DE | 11 13 537 | 9/1961 |
| DE | 44 02 706 | 6/1995 |

* cited by examiner

*Primary Examiner*—Danny Worrell
(74) *Attorney, Agent, or Firm*—Venable; Norman N. Kunitz

(57) ABSTRACT

The latch needle according to the invention is provided with a latch slot with profiled inside areas of the cheeks. A latch is positioned inside this latch slot, for example with the aid of a rivet. The inside areas of the cheeks that immediately surround the rivet guide the latch on the side and together with the latch define a small play, thus resulting in a precise positioning. The remaining latch slot area can be wider to reduce the latch friction at the latch slot as much as possible.

14 Claims, 5 Drawing Sheets

LATCH NEEDLE HAVING A STEPPED SAW SLOT

BACKGROUND OF THE INVENTION

The invention relates to a latch needle, in particular for knitting machines, with the features as listed in the preamble to patent claim 1.

Latch needles are used for different types of knitting machines in use. A latch needle is known, for example, from German Patent 1113537. The latch needle has a needle body with a hook formed onto its end. A latch slot is formed near the hook, in which a latch is positioned so as to pivot. The latch slot cheeks and the side surfaces of the latch shank function to guide the latch on the side. As a result, the latch can rest with its free end, the so-called latch spoon, on the hook tip and can thus close off the trapping clearance. From this closed position, the latch can pivot back to the latch upright position, in which it frees the trapping clearance. A rivet or pin ensures the pivoting positioning of the latch.

The pivoting movement should be as easy as possible. Modern knitting machines often require needles with extremely easy-moving latches, which should also be guided with the highest possible precision. The easy movement should be ensured for new needles as well as old ones. Needles with hard-to-move latches knit irregularly and thus create a poor loop picture.

The latches of some machines must return during the knitting operation to the upright position as a result of their own weight. If this does not happen reliably, the danger exists that the latches come in contact with machine parts, e.g. the yarn-feed apron, and are thus bent.

The easy movement of the latch can be achieved with increased latch play. Dirt, fiber residues and the like, which enter the latch slot, can consequently cause fewer problems for the smooth running of the latch. The increased latch play, however, worsens the latch guidance even if the needle is still new because the needle latch spoon can no longer hit the hook precisely and thus cannot reliably close off the yarn trapping clearance. With increasing wear, the latch guidance becomes more and more difficult, which in turn can reduce the operational reliability.

A different problem is caused by the increased latch play if the latch is positioned with rivets punched out of the slot cheeks, as disclosed in U.S. Pat. No. 1,991,140. The latch that is provided with a pivoting opening is inserted into the latch slot to position the latch. Following this, portions of the slot cheeks are subsequently pressed or punched toward the inside with the aid of two pressure feet (plunging tools), such that these enter the pivoting opening for the latch and form a positioning rivet for the latch. This operation requires relatively little latch play. In particular with the area surrounding the pivoting opening, the latch forms an abutment for the pressure or punching operation. If the latch is noticeably smaller than the latch slot, a precise positioning of the latch for the punching or pressing operation is not possible. As a result, the latch needle possibly cannot be produced with the desired quality.

During the latch closing movement, the thread or a yarn glides along the surface of the latch slot cheeks, driven by the underside of the latch shank, and into the hook clearance. In the process, the problem of the thread being damaged by sharp edges of the latch slot or the latch shank occurs with increasing frequency and, in the extreme case, can lead to a break in the thread.

Another problem that can occur with increased play between latch shank and latch slot is that the thread is caught between the latch shank and the cheek of the latch slot. This reduces the easy mobility of the latch and can even lead to the needle becoming totally inoperable.

Starting with this, it is the object of the invention to provide a latch needle with a precisely guided, easy moving latch.

SUMMARY OF THE INVENTION

The above object generally is achieved by a latch needle having the features according to the present invention.

The latch needle according to the invention is provided with a latch slot that is delimited by two cheeks, the insides of which are positioned opposite each other. The inside surfaces of the cheeks are respectively divided into at least two surface regions, one of which is located directly adjacent to the pivoting mechanism and thus forms a pivoting surface. This surface area advantageously surrounds the pivoting mechanism and functions to guide the latch on the side, thus limiting its pivoting play on the side. The other surface area is positioned at a distance to the pivoting mechanism and defines a comparably larger slot width. The cheek is recessed, so-to-speak, in this surface area so that a clearance develops between the latch shank and the latch slot cheek, which promotes the easy movement of the latch. The clearance that develops between the latch shank and the cheek can take up fiber filaments without this essentially reducing the easy movement of the latch. Threads, fibers or filaments and dust in particular can thus be prevented from being caught between the cheek and the latch shank.

The latch needle according to the invention combines improved latch guidance with decreased frictional resistance and additional clearance space for fibers and filaments.

This applies in particular if the measure according to the invention is not used on one cheek only, but on both cheeks. The resulting latch needle is symmetrical relative to a center plane on which the pivoting axis of the latch is positioned perpendicular. With this latch needle, the frictional resistance of the latch is reduced on both sides.

For the needle according to the invention, the latch slot width is narrower in at least one location near the pivoting mechanism than in at least one other location, at a longer distance thereto. An edge, a step or a curved section can be used as transition between the corresponding surface areas on the cheek inside. The edge between the two surface areas can be either sharp or round. The surface areas can have a flat or arched design. In particular, the surface area that is arranged at a distance to the pivoting mechanism can be curved.

Whereas the cheek surface areas, which define a narrow slot width, are formed at the pivoting mechanism or around it, the other surface areas are preferably located at the area where the slot ends and follow the needle outline, for example the needle top surface. The surface areas in that case can form a strip that adjoins the area where the slot ends. Alternatively, the respective cheek surface area can be recessed and shaped in such a way that a projection is formed on both sides of the latch shank at the respective cheek, which serves the same purpose as a washer arranged on the rivet. These projections center and guide the latch in the center of the latch slot.

The pivoting mechanism for the latch needle preferably is a continuous rivet, but can also be a divided one. The latter can be produced in that portions of the cheek are pushed into a latch opening during a reshaping process. The rivet can be produced by punching it out of the cheek or by inserting a separate pin.

The tongue play on the side advantageously amounts to only a few $1000^{th}$ millimeters, e.g. approximately 0.02 millimeters or less, near the pivoting mechanism. In contrast, the latch play in the expanded latch slot region (other surface areas) is noticeably higher, for example more than 0.03 millimeters. A sufficiently large slot or clearance space is thus created between the side surfaces of the latch and the cheek insides. This gap or clearance can be uniformly wide or can be shaped in the form of a wedge and preferably extends over at least a portion of the latch pivoting range. The gap or clearance can be divided into sections that can extend, for example, from the pivoting end positions to near the area of the pivot. To facilitate the complete return of the latch to the upright position, the expanded latch slot region can also extend further to the location where the latch is standing upright.

Additional advantageous details of the invention follow from the subsequent description, the drawing or the dependent claims.

BRIEF DESCRIPTION OF THE DRAWINGS

Exemplary embodiments of the invention are illustrated in the drawing and show in.

DESCRIPTION OF THE PREFERRED EMBODIMENTS

Figure 1:
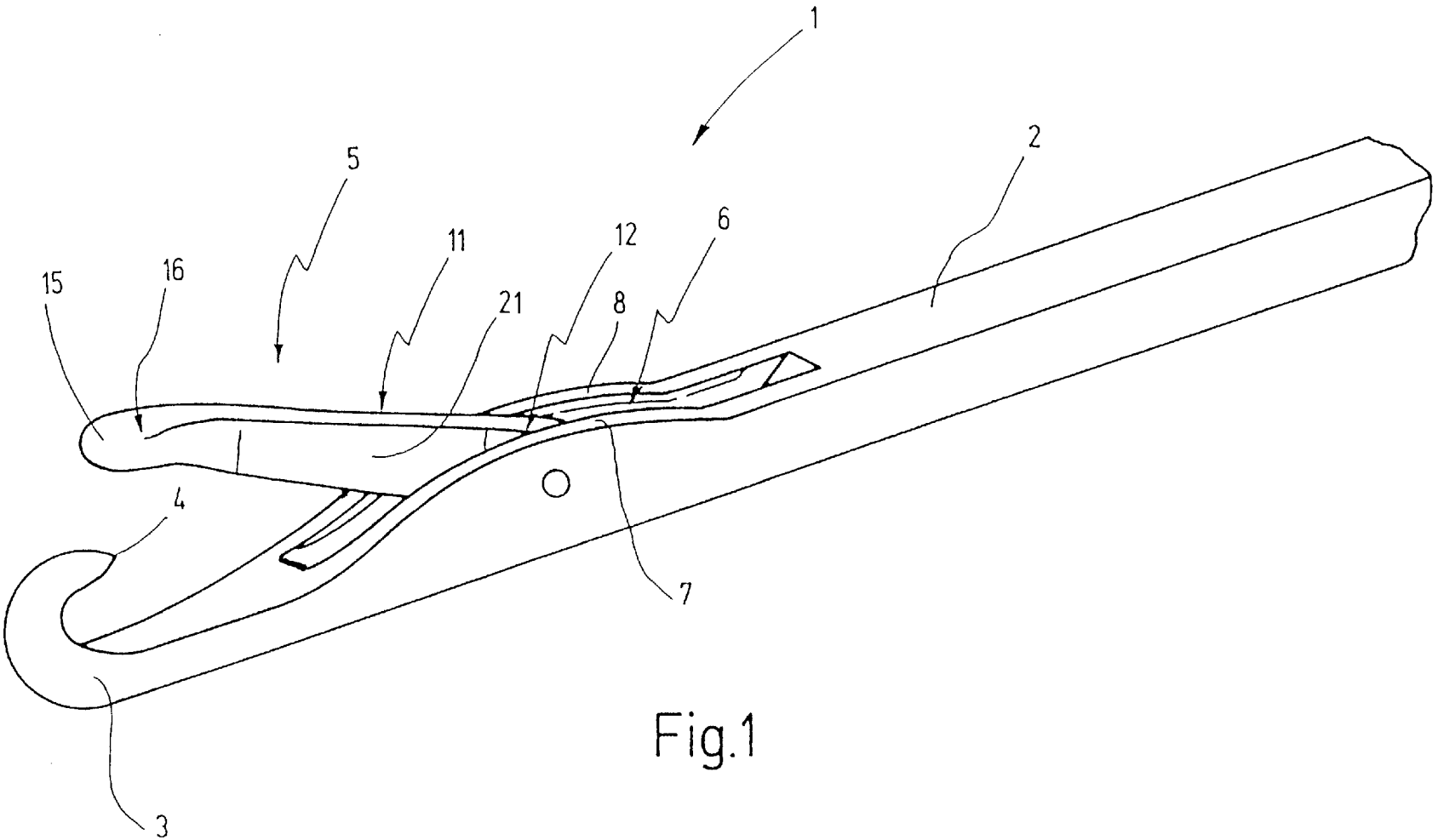
FIG. 1 A latch needle in a perspective and schematic representation, showing details.

FIG. 1 shows a basic design of a latch needle 1. The latch needle 1 has a needle body 2 with a hook 3 formed onto its free end. The hook ends in a hook tip 4, which functions as counter stop and support for a latch 5 that is positioned pivoting on the needle body 2. A latch slot 6, which is delimited by two cheeks 7, 8, is formed into the needle body 2 for accommodating the latch 5. The cheeks 7, 8 are respectively designed mirror-symmetrical to each other and are arranged parallel to each other.

Figure 2:
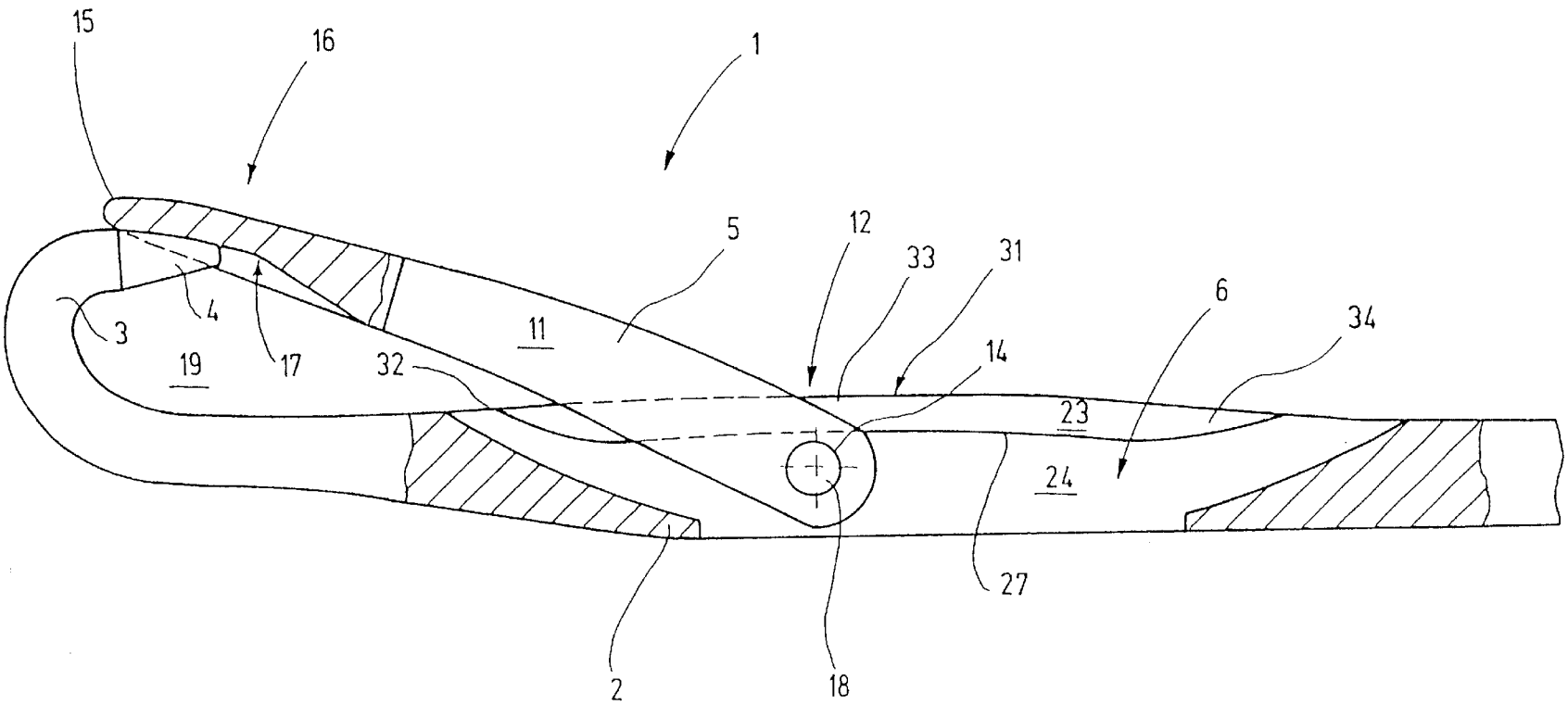
FIG. 2 The latch needle shown in FIG. 1, in a partial section view from the side and showing details.

The latch 5 has a latch shank 11, which projects with one end 12 into the latch slot 6. FIG. 2 in particular shows that the end 12 is provided with a latch opening 14 for positioning the latch 5. At the opposite end 15, the latch 5 has a latch spoon 16 with a recess 17 (noucat) on the hook side. The present embodiment is a needle with noucat latch. Alternatively, a noucat can be provided in the hook 3 or its hook tip 4, into which a correspondingly tapered section of the latch 5 fits. In the closed position (FIG. 2), the latch 5 closes off the hook clearance 19.

Figure 3:
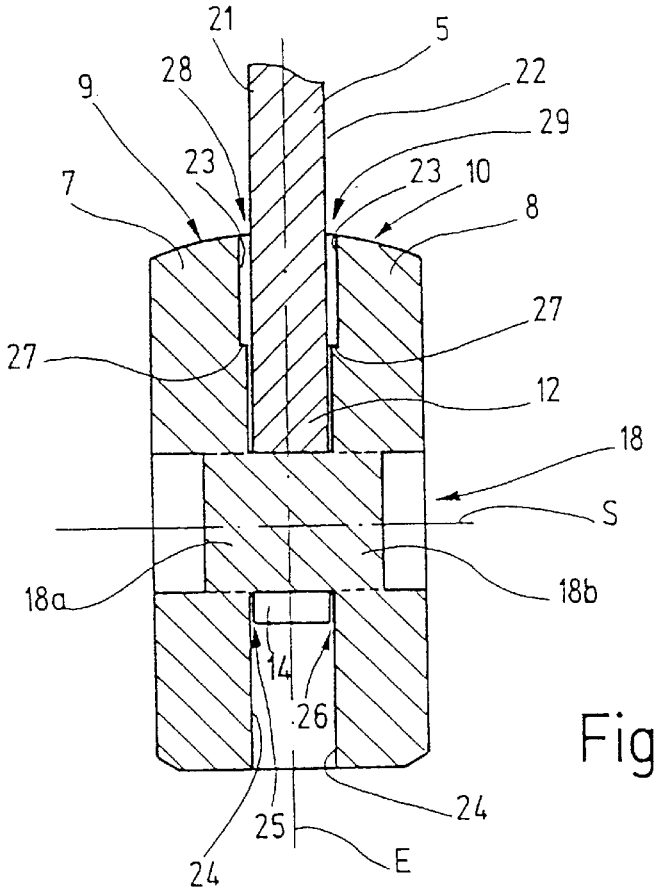
FIG. 3 The latch needle according to the FIGS. 1 and 2, shown as cross-sectional and detailed view on a different scale.

According to FIG. 3, the latch 5 is positioned pivoting inside the latch slot 6 with the aid of a rivet 18, consisting of two rivet halves 18*a*, 18*b*. FIG. 3 also illustrates that the rivet halves 18*a*, 18*b* are formed by wall sections of the cheeks 7, 8, which sections are pressed with a pressing or punching technique from these cheeks and into the latch opening 17 [sic].

The latch 5 has two side surfaces 21, 22, which can be formed level and parallel to each other. If necessary, the side surfaces 21, 22 can also be oriented at an angle toward each other, so that the latch 5 has an approximately wedge-shaped design. The side surfaces 21, 22 can be flat, curved, stepped or have other outlines. It is preferable if the latch 5 is designed symmetrical to a center plane, on which a pivoting axis S, determined by the rivet 18, is arranged perpendicular.

The cheeks 7, 8 are also symmetrical to this center plane, as indicated by the dash-dot line E in FIG. 3. The following description of the cheek 7 therefore also applies to the cheek 8.

The inside area of cheek 7 is subdivided into two surface areas 23, 24. The surface areas 23, 24 are separated and determine different slot widths. The surface area 24 is arranged immediately adjacent to the pivoting mechanism formed by the rivet 18. In particular in the region of the pivoting mechanism, meaning the rivet 8 [sic], it determines a slot width that is only slightly wider than the width of the latch 5 at this location. Thus, a pivoting gap 25, 26 of only a few $1000^{th}$ millimeters is formed at the pivoting mechanism, on both sides of the latch 5. The pivoting play determined by both pivoting gaps 25, 26, for example, is limited in this case to 0.02 mm.

On the other hand, the surface areas 23 determine a comparatively wider slot width in that the surface areas 23 change via a step 27 over to the surface areas 24, as shown in FIG. 3. A gap 28, 29 consequently results between the respective side surface 21, 22 of latch 5 and the surface area 23. The average or median width of this gap is wider than the average or median width of the pivoting gap 25, 26. The gap depth is determined by the height of the surface area 23. The height of surface area 23 (measured between needle top 31 and opposite arranged needle back) is advantageously higher than half the distance between the pivoting rivet 18 and the needle top surface. The thickness of the cheek 7, 8 can serve as alternative reference for the depth of the recess. The height of surface region 23 is preferably higher than this depth, thus making it possible to achieve the desired ease of movement and the desired precision.

The latch needle 1 described in the above operates as follows:

During the operation, the latch needle 1 performs a back and forth movement, during which the needle body 1 moves back and forth along its longitudinal direction. The latch 5 in the process performs a back-and-forth moving pivoting movement around the pivoting axis S, from a closed position shown in FIG. 2, via an intermediate position according to FIG. 1, into an upright position and back. Starting with the upright position, the thread driven by latch shank 11 glides over the top surfaces 9, 10 of cheeks 7, 8 and into the hook clearance 19.

The latch needle 1 described so far consequently exhibits improved knitting behavior.

As shown in FIG. 3, the end 12 of latch 5 for latch needle 1 is guided on the rivet 18 inside the latch slot 6. In the ideal case, the latch is guided only by the surface areas 24 of cheeks 7, 8, but not the surface areas 23. The latch shank 11 insofar is positioned freely inside the latch slot 6 and in particular does not make contact with the surface areas 23. The end 12 of latch 5 is guided by the surface areas 24 with such precision that the latch spoon 16 hits the hook 3 or the hook tip 4 with only a slight center deviation. The precise guidance of latch 5 represents a wear reserve, meaning even if the play on the side of latch 5 increases with increasing wear, it still remains within permissible tolerances. The recessed surface areas 23 with gaps 28, 29 create clearances, which prevent or reduce any hindrance of the latch 5 movement, even if oil, fiber residues or dirt are deposited along the side surfaces 21, 22 of latch 5 and/or the inside areas of cheeks 7, 8.

The precise guidance of the latch 5 near the pivoting mechanism by the surface areas 24 prevents a contact between the side surfaces 21, 22 of latch 5 and the surface areas 23, even if the pivoting play of the latch 5 increases somewhat following a longer period of operation by the latch 5 and the start of wear.

The latch slot 6 of one preferred embodiment of the invention extends through the needle body 2, as shown in FIG. 2, and is open on the top (needle top 31) as well as the back. The area on the needle top where latch slot 6 ends is widened through an additional milling or stamping, which creates the step 27 and the surface areas 23. The surface area 23 consequently extends from one end 32 of the hook across a center region 33, located approximately above the pivoting mechanism, to an end region 34, occupied by the shank 11 of latch 5 when in the upright position. As a result, this surface area 23 extends nearly over the complete pivoting range of latch 5. Owing to this special design of the surface area 23, the latch 5 is guided precisely, in particular in the closed position and the upright position because the shank 11 of latch 5 thus enters deeper into the narrower latch slot region defined by the surface areas 24. In the final analysis, this is achieved in that the surface area 23 with an approximately constant width follows the outline of the needle top surface 31.

Figure 6:
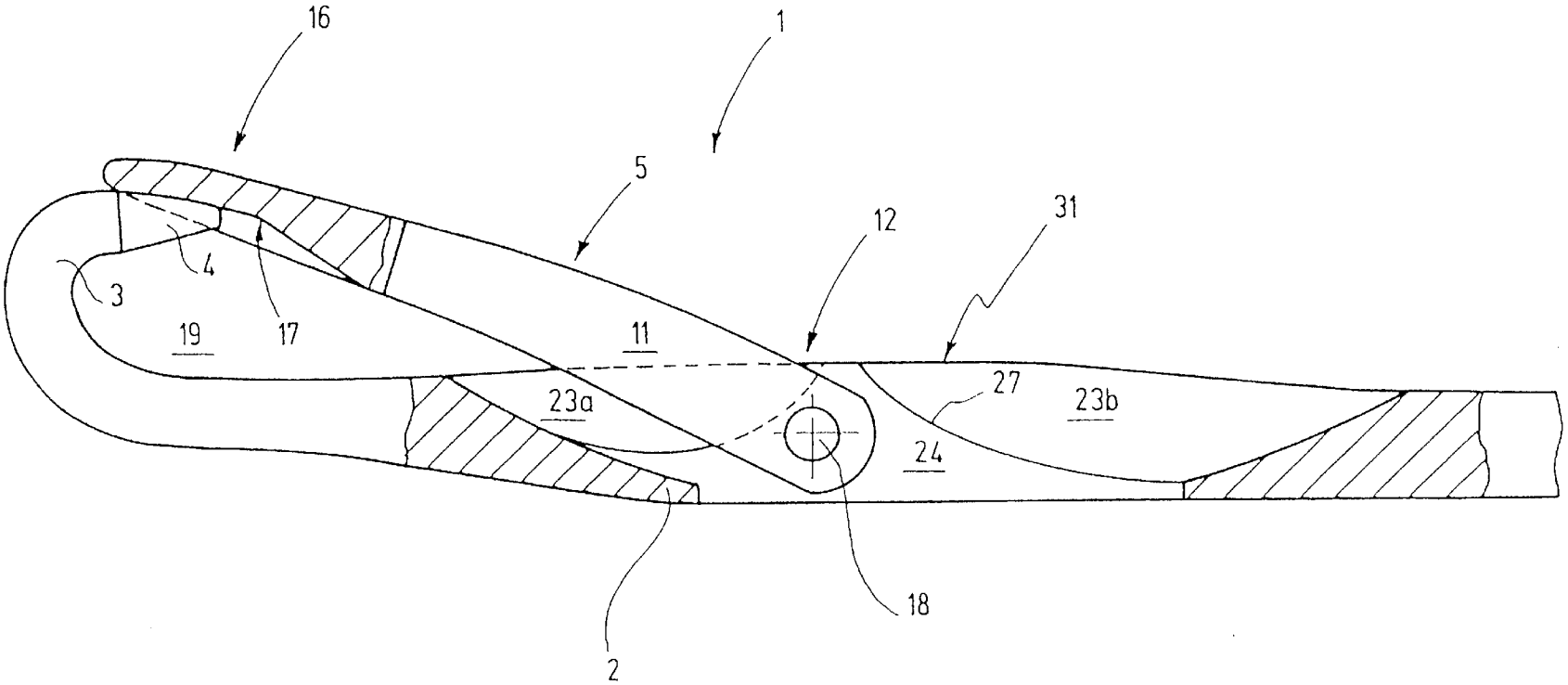
FIG. 6 A different modified embodiment of the latch needle, in a partial sectional and schematic view from the side.

Alternatively, the shape of surface area 23 can deviate from the strip shape, so that the step 27 no longer follows the outline of the needle top surface 31. Also, the surface area 23 can be divided into partial surface areas 23*a*, 23*b*, for example as shown in FIG. 6. As a result, it is possible to combine a far-reaching reduction in the latch friction with a precise positioning and guidance.

Figure 4:
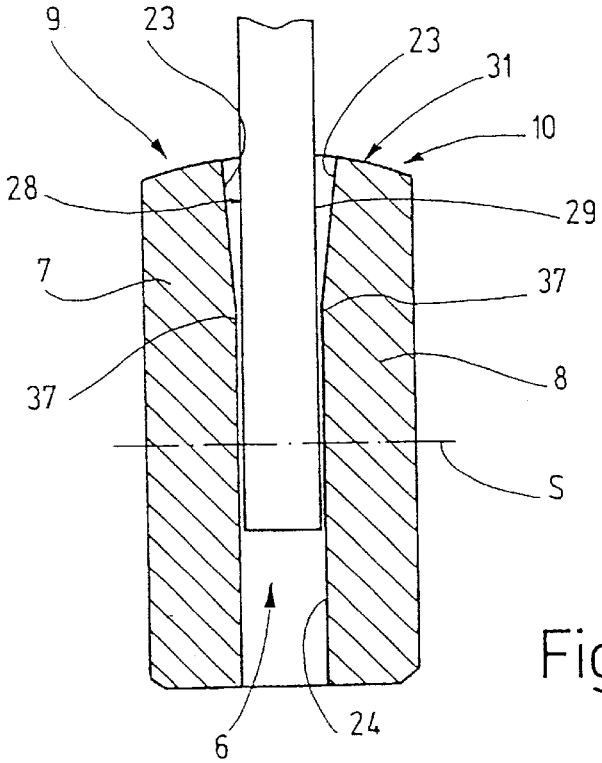
FIG. 4 A modified embodiment of the latch needle as cross-sectional representation, in a simplified view.

FIG. 4 shows that for one alternative embodiment, for which the surface areas 23, 24 can be designed according to FIG. 2 as well as FIG. 6 or can have a different design, an edge 37 is provided in place of the step 27, which separates the surface areas 23, 24. For reasons of clarity, the pivoting mechanism is not shown in FIG. 4 and is only symbolized with the aid of the pivoting axis S. This mechanism can be either a pin or a rivet. The surface areas 23, 24 are essentially flat, as for the exemplary embodiment in the above. However, in contrast to the aforementioned embodiment according to FIG. 3, they are not arranged parallel to each other in this case (FIG. 4). The surface areas 23 form a funnel-shaped expansion of the latch slot 6 in the direction of the needle top surface 31. The gaps 28, 29 thus become wedge-shaped, wherein the gap width is larger at least in the area where the latch slot 6 ends than the distance between the surface areas 24. The average gap width, which can be measured approximately in the center of the surface region 23, is preferably noticeably larger, meaning by a few $1000^{th}$ millimeter, than the gap width between the surface areas 24.

Figure 5:
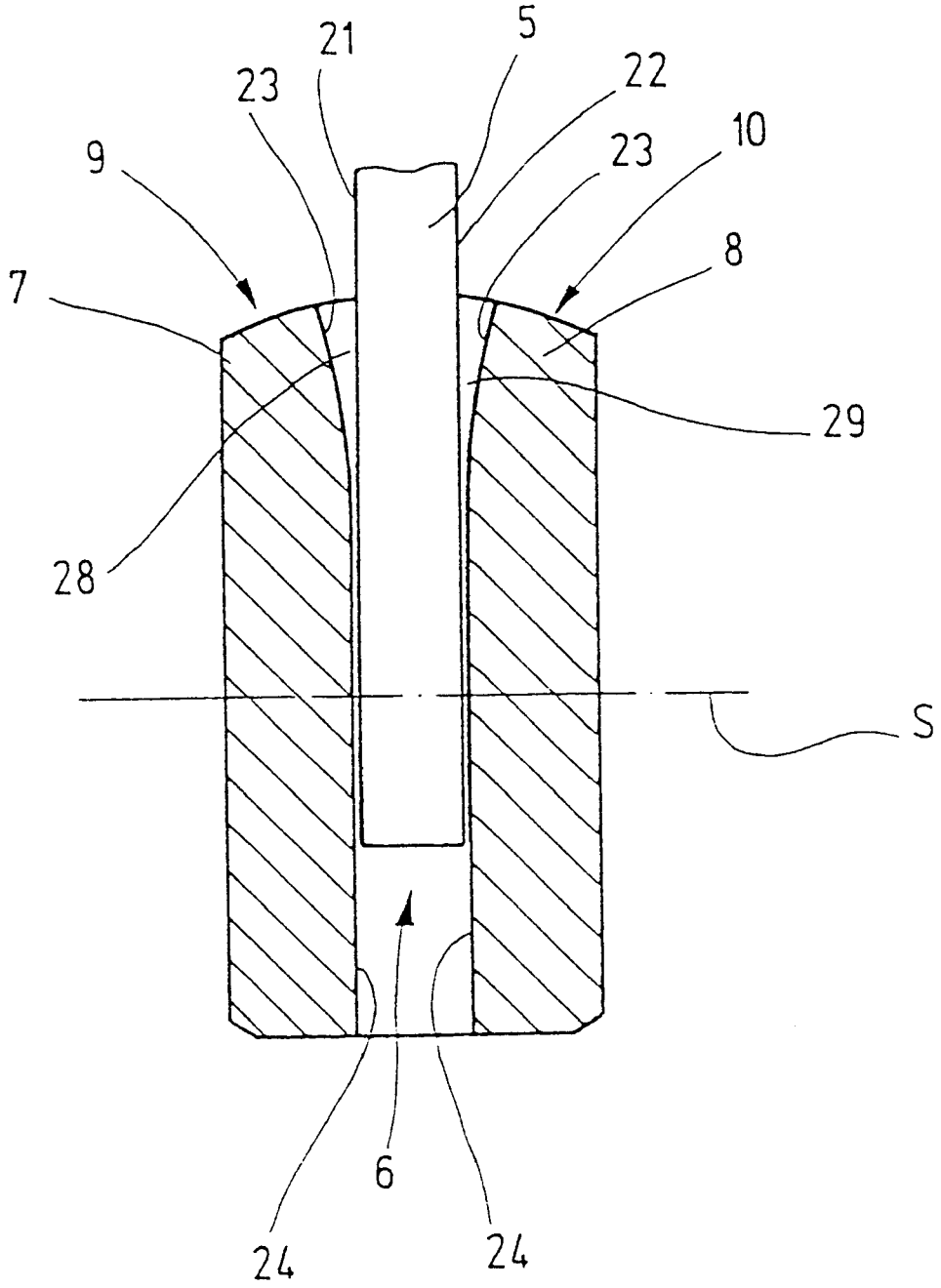
FIG. 5 A modified embodiment of the latch needle as cross-sectional representation, in a simplified view.

As shown in FIG. 5, the surface areas 23 can also have a curved design or can transition with a curvature to the surface areas 24. This also results in a funnel-shaped expansion of the latch slot 6, which reduces the friction of latch 5, wherein the surface areas 24 ensure an excellent guidance of the latch. These areas are preferably planar surfaces that enclose the rivet 18.

The latch needle 1 according to the invention is provided with a latch slot 6 with profiled inside surfaces of the cheeks 7, 8. A latch 5 is positioned inside the latch slot 6, for example with the aid of a rivet 18. The inside areas of cheeks 7, 8 that are located immediately adjacent to the rivet 18 function to guide the latch 5 on the side and with this guidance define an insignificant play. The latch is precisely positioned in this way. The remaining latch slot 6 can have a larger slot width to reduce the latch 5 friction inside the latch slot 6 as much as possible.

What is claimed is:

1. A latch needle comprising:

a needle body with a latch slot formed therein, which is delimited by inside areas of two opposite-arranged cheeks and ends at a top surface of the needle body;

a latch with a latch shank that extends into the latch slot and is provided with a latch opening; and a pivoting mechanism arranged inside the latch slot, with which the latch is positioned inside the latch slot, such that the latch can pivot between a closed position and an upright position; and wherein at least one of the opposite-arranged inside areas is divided in separate surface areas, one of which is arranged near the pivoting mechanism and the other one at a distance to the pivoting mechanism and the slot width of the latch slot that is delimited by the surface areas at a distance to the pivoting mechanism is wider than the slot width delimited by the surface areas that are adjacent to the pivoting mechanism, and the clearance between the surface areas at a distance to the pivoting mechanism and flanks of the latch shank are greater than the clearance between the flanks of the latch shank and the surface areas that are adjacent the pivoting mechanism.

2. A latch needle according to claim 1, wherein both cheeks of the latch needle are divided into separate surface areas.

3. A latch needle according to claim 1, wherein a line-shaped or strip-shaped separation area is formed between the surface areas in order to separate these areas.

4. A latch needle according to claim 1, wherein a step is formed as a separation area between both surface areas in order to separate these areas.

5. A latch needle according to claim 1, wherein an edge is formed as a separation area between both surface areas in order to separate these areas.

6. A latch needle according to claim 5, wherein the edge is rounded.

7. A latch needle according to claim 3, wherein the separation area is follows the outline of the needle top on the side where the latch projects from the latch slot.

8. A latch needle according to claim 1, wherein the separation area has a curved shape.

9. A latch needle according to claim 1, wherein the surface area that is removed from the pivoting mechanism forms an end area of the latch slot that is expanded.

10. A latch needle according to claim 1, wherein the surface area that is removed from the pivoting mechanism extends at least into an area occupied by the latch in the closed position.

11. A latch needle according to claim 1, wherein starting with the needle top, the surface area that is removed extends into the latch slot by a distance that is greater than half the distance between the needle top and the pivoting mechanism.

12. A latch needle according to claim 1, wherein the depth of the recess determined by the surface area at least equals the wall thickness of the respective cheek.

13. A latch needle comprising:

a needle body with a latch slot formed therein that is delimited by inside areas of two opposite-arranged cheeks and ends at a top surface of needle;

a latch with a latch shank that extends into the latch slot and is provided with a latch opening; and, a pivoting mechanism arranged inside the latch slot and with which the latch is positioned inside the latch slot such that the latch can pivot between a closed position and an upright position; and wherein at least one of the opposite-arranged inside areas is divided in separate surface areas, one of which is arranged near the pivoting mechanism and the other one at a distance to the pivoting mechanism and the slot width of the latch slot that is delimited by the surface areas at a distance to the pivoting mechanism is wider than the slot width delimited by the surface areas that are adjacent to the pivoting mechanism; and wherein an edge is formed as a separation area between both surface areas in order to separate these areas, and the edge is rounded.

14. A latch needle comprising:

a needle body with a latch slot formed therein that is delimited by inside areas of two opposite-arranged cheeks and ends at a top surface of needle;

a latch with a latch shank that extends into the latch slot and is provided with a latch opening; and, a pivoting mechanism arranged inside the latch slot and with which the latch is positioned inside the latch slot such that the latch can pivot between a closed position and an upright position; and wherein at least one of the opposite-arranged inside areas is divided in separate surface areas, one of which is arranged near the pivoting mechanism and the other one at a distance to the pivoting mechanism and the slot width of the latch slot that is delimited by the surface areas at a distance to the pivoting mechanism is wider than the slot width delimited by the surface areas that are adjacent to the pivoting mechanism; and, wherein a separation area formed between the surface areas in order to separate these areas has a curved shape.

* * * * *